US005189327A

United States Patent [19]

Ootsuka et al.

[11] Patent Number: 5,189,327

[45] Date of Patent: Feb. 23, 1993

[54] AXIAL-FLOW FAN MOTOR WITH MODULAR CONNECTOR

[75] Inventors: Shigeru Ootsuka, Yonago; Naoki Nakada, Saihaku; Takehito Tsukada, Yonago, all of Japan

[73] Assignee: Matsushita Electric Industrial Co., Ltd., Kadoma, Japan

[21] Appl. No.: 750,866

[22] Filed: Aug. 28, 1991

[30] Foreign Application Priority Data

Aug. 29, 1990 [JP] Japan ..... 2-229367

[51] Int. Cl.[5] ..... H02K 5/04; F04B 35/04

[52] U.S. Cl. ..... 310/71; 310/89; 417/354

[58] Field of Search ..... 310/67 R, 71, 89, 42; 415/119, 142; 416/203; 417/353, 354, 423.7, 423.12

[56] References Cited

U.S. PATENT DOCUMENTS

| | | | |
|---|---|---|---|
| 2,629,041 | 2/1953 | Fein et al. | 439/928 |
| 2,855,141 | 10/1958 | van Rijn | 417/354 |
| 3,310,698 | 3/1967 | Krell | 310/258 |
| 3,644,066 | 2/1972 | Heob et al. | 417/354 |
| 3,700,358 | 10/1972 | Papst et al. | 417/354 |
| 4,233,534 | 11/1980 | Tharman | 310/71 |
| 4,482,302 | 11/1984 | Grignon | 417/354 |
| 4,526,431 | 7/1985 | Kasukawa | 439/723 |
| 4,636,669 | 1/1987 | Plunkett et al. | 310/51 |
| 4,773,828 | 9/1988 | Hagiwara et al. | 310/67 R |
| 5,096,373 | 3/1992 | Struve et al. | 415/60 |
| 5,099,181 | 3/1992 | Canon | 318/254 |

*Primary Examiner*—Steven L. Stephan
*Assistant Examiner*—D. R. Haszko
*Attorney, Agent, or Firm*—Cushman Darby & Cushman

[57] ABSTRACT

A brushless dc axial-flow fan motor contained in a housing, composed of an outer frame forming its periphery, a center hub and several spokes radially extending from the center hub to the outer frame. One of the spokes is capable of accommodating at least a plug or receptacle for connecting the fan motor to a power source, and is actually holding either one of the connector halves.

9 Claims, 4 Drawing Sheets

AXIAL-FLOW FAN MOTOR WITH MODULAR CONNECTOR

FIELD OF THE INVENTION AND RELATED ART STATEMENT

1. Field of the Invention

The present invention relates to a brushless dc axial-flow fan motor, and, in particular, a configuration of spokes of a housing which also serves as an outer frame of the brushless dc axial-flow fan motor used for cooling an electronic appliance of apparatus and the like.

2. Description of the Prior Art

In recent years, as the rapid development of miniaturization, i.e., reduction in weight and size, of electric or electronic appliances or apparatus and the like, which accommodate numerous components in a limited space with high density, installation of brushless dc axial-flow fan motors for removing heat generated by the components has been increased year by year. Under such circumstances, development of a more compact and handy brushless dc axial-flow fan motor has been required in the direction of summarization, compactness of configuration, as well as cost-reduction in design of the components which constitute the fan motor. And the competition in the market is increasingly being intensified, accordingly.

In the following paragraphs, a conventional structure of a brushless dc axial-flow fan motor will be described with reference to the attached drawings.

FIG. 4 illustrates a typical example of the conventional structure of the prior art.

As shown by this figure, a housing 1 comprises an outer frame 2, four spokes 3, and a center hub 5. As is known, the center hub 5 contains a stator core, stator windings, a bearing unit (which are not shown), and a printed circuit board 4 which packages a driving circuit and the like. In the interior of any one 31 of said four spokes 3, which serves to accommodate lead wires, there is provided an oblong cavity 81 with guide rails 7 for guiding lead wires 6 for connecting the motor to a power source. Conductors of the two lead wires 6 are directly soldered onto lands 9 of the printed circuit board 4. The lead wires 6 are contained in the oblong cavity 81 along the lead-wire guide rails 7, and directed to a lead-wire outlet which has clamps 10 for clamping the lead wires 6 to prevent possible slipping off of the lead-wires.

The conventional structure as described-above, however, is disadvantageous in that standardization of the dc axial-flow fan motors is difficult, because these dc axial-flow fan motors are manufactured, so as to conform to a large number of different kinds and types of lead wires-depending on diversified technical specifications. For instance, many different kinds or types of fan motors with various lengths of lead wires with various kinds of connectors at the other ends of the lead wires are requested by a customer, or by designs of electric or electronic appliance. Another problem or drawback of the conventional structure is a high rejection rate caused, e.g., by a possible mismatch between the lead wires and the motor itself resulted from the complexity due to the insufficient standardization, and by a possible considerable delay in ordering and receiving well-selected lead-wires of complex technical specification.

Further, it has been difficult to automate the soldering process of the lead-wire, so long this has long been carried out by hand work of assembly workers. Furthermore, the conventional configuration is disadvantageous because of the large number of steps required to handle the lead-wires due to their disbundling, and in time loss caused by change-over between the different kinds or types of lead wires.

OBJECT AND SUMMARY OF THE INVENTION

The present invention intends to overcome the above-mentioned drawbacks inherent in the prior-art, and has, as its object, a provision of a dc axial-flow fan motor, which has a simple configuration and is well suited for automation in the assembling process.

According to the present invention, a brushless dc axial-flow fan motor having a housing, which also serves as an outer frame of the dc axial-flow fan, comprises several spokes radially extending from a center hub to the periphery of said housing, the center hub containing a driving unit including a control circuit, a stator core, stator windings and the like, and a bearing for holding the shaft of a fan rotor; and the dc axial-flow fan motor comprises a cavity provided in one of said spokes for accommodating at least one of a plug or a receptacle for connecting the fan motor to a power source, either one of said plug or receptacle being firmly held in said cavity.

In the above-mentioned brushless dc axial-flow fan motor, said cavity may be formed to contain an engaging unit for holding said plug or receptacle. The engaging unit may, for instance, be a pair of protrusions provided on the side walls of said cavity.

Said cavity and an insert-guiding unit may preferably be formed at the same time as the molding of said spokes.

By structuring the dc axial-flow fan motor as summarized in the above, it is possible to replace the direct solder-connected lead-wires, which had been complex in handling and had a large number of kinds or types imposed by the technical specifications of the customers, by adoption of combination of plug and receptacle, and to realize the intended standardization of the fan motor. Further, the conventional lead-wire soldering step in the assembling process of the dc axial-flow fan motor can be replaced by a step of soldering lead pins of a small plug or receptacle to the circuit board of the fan motor. Thus, the automation of the soldering process, which had long been difficult to attain, is now realized. Only one small plug or receptacle has to be held in the cavity by engaging protrusions for retaining it therein.

As previously described, the present invention is advantageous in that the standardization of the dc axial-flow fan motors, wherein hitherto the standardization had been difficult because of numerous technical specification of the lead wires, is now made possible. The attained standardization serves to shorten the period for delivery to the customers, and to realize the decrease in rejection rate caused by a possible mismatch between the lead wires and the motor itself.

As a collective advantage of the abovementioned structure, the reductions in the number of the components and in the number of the process steps as well as the reduction in the manufacturing cost can also be realized.

While the novel features of the present invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENT

In the following paragraphs, a preferred embodiment of the present invention will be described with reference to the accompanying drawings.

Figure 1:
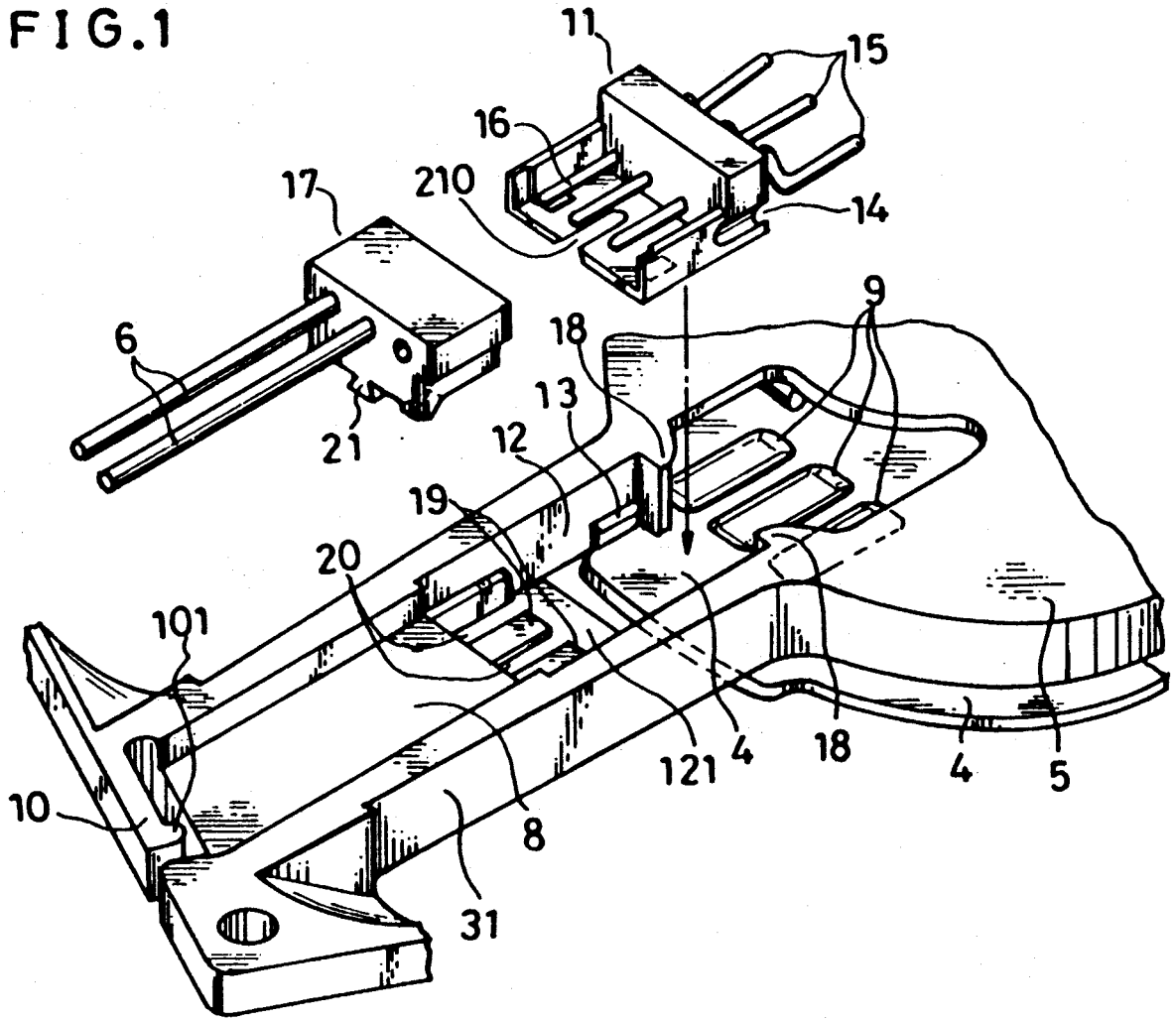
FIG. 1 is an exploded perspective view showing a spoke for accommodating the combination of pin-plug and receptacle with lead-wires of an embodiment of the brushless dc axial-flow fan motor built in accordance with the present invention.

FIG. 1 shows a spoke of the brushless dc axial-flow fan motor built in accordance with the present invention. Similarly to the conventional brushless dc axial-flow fan motor, the fan motor in accordance with the present invention also comprises a housing including an outer frame, four spokes 3 and a center hub 5. The center hub 5 contains, therein, a stator core, stator windings, a bearing unit, and a printed circuit board 4 which packages a driving circuit and the like. As shown in FIG. 1, a lead-wire conduit groove 8 is provided in the interior of one of the four spokes 31. Also a cavity 12 is provided therein for accommodating a known post-head assembly or plug 11 having plural connection pins 16 and the soldering pin ends 15. A pair of engaging protrusions 13 for holding the plug 11 are provided on both side walls of the cavity 12. The engaging protrusions 13 are formed to hold the plug 11 by engaging with recesses 14 which are formed on both sides of the plug 11. Therefore, the plug 11 is fixed and hence retained in the cavity 12 of the spoke 31. The retained plug 11 is supported and fixed by the engaging protrusions 13, and soldering pin ends 15 of the pins are soldered on corresponding lands 9 of a printed circuit board 4.

The spoke 31 also has another pair of stop protrusions 18 for supporting the plug 11. The stop protrusions 18 have a function of receiving hence stopping a stress which will be produced on the other ends 16 of the pins at the time of coupling by pushing a receptacle 17 to the plug 11 for making mechanical and electric connections. Therefore, no undesirable stress is given on the soldering pin ends 15 and the lands 9. In the spoke 31, there is also provided guide rails 19 for guiding the receptacle 17 with lead wires 6 extending from an appliance or apparatus specified by the customer. When coupling the receptacle 17 to the plug 11, the guide rails 19 serve to assist its smooth sliding for coupling.

Figure 2:
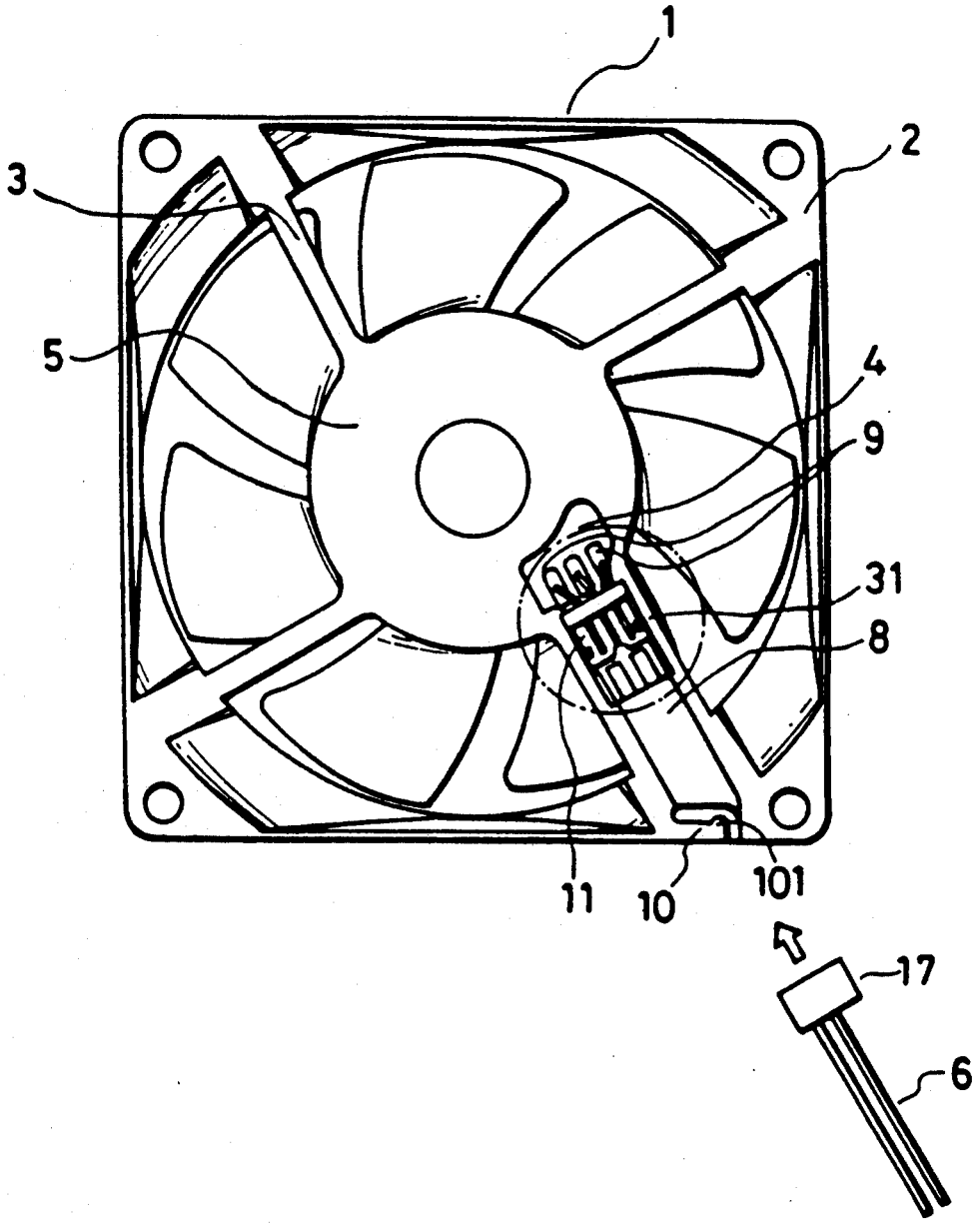
FIG. 2 is a plan view showing the embodiment of the brushless dc axial-flow fan motor including a in-plug when being assembled into the structure shown by FIG. 1.
Figure 4:
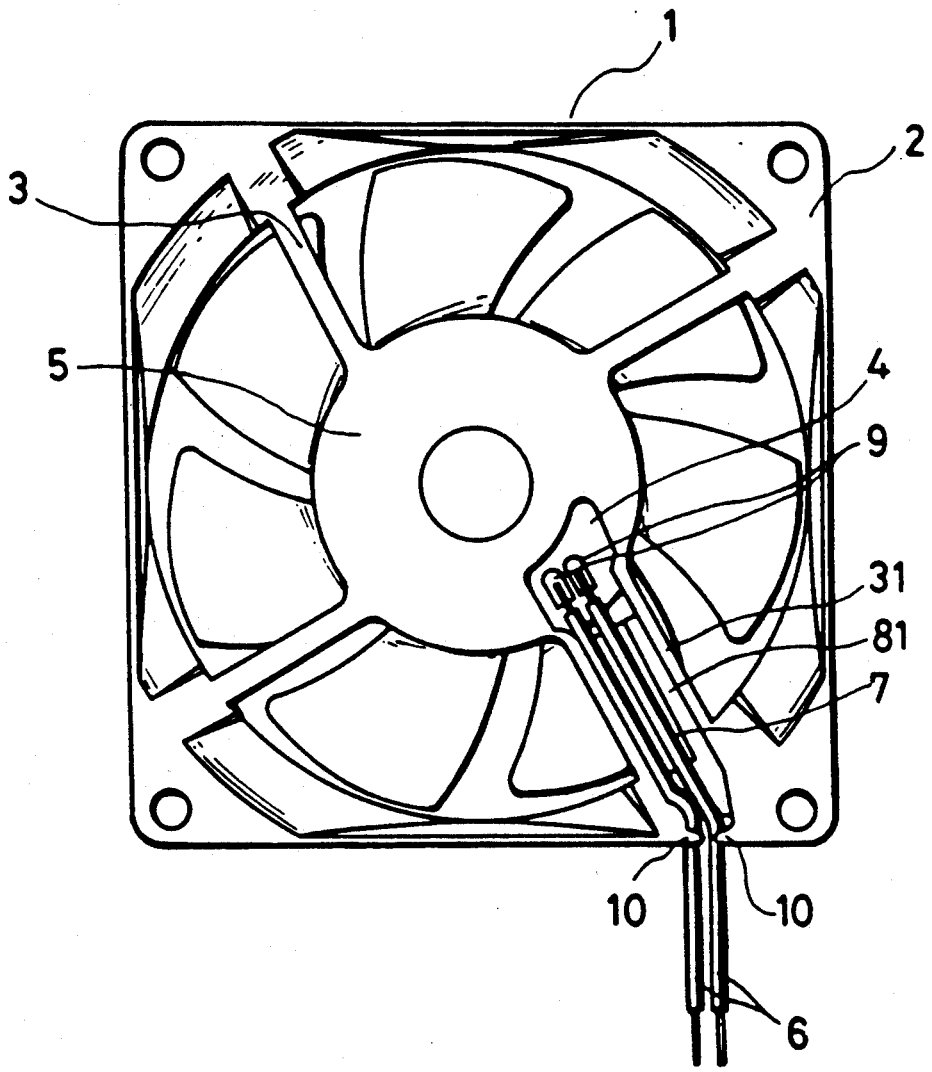
FIG. 4 (Prior Art)
FIG. 4 is a plan view showing a spoke for accommodating the lead-wires of a conventional brushless dc axial-flow fan motor.

Grooves 20 of the guide rails 19 are formed with such widths that can easily receive putting down from an upper place of the projection 21 with dovetail-shaped section, which is formed on the bottom of the receptacle 17. The projection 21 of the dovetail-shaped section is to slidingly engage into a groove 210 of the dovetail-shaped section, when the receptacle 17 is coupled to the plug 11. The receptacle 17 is accommodated in the cavity 12. The lead wires 6 are accommodated in the lead-wire conduit groove 8 like the prior art shown in FIG. 4. The lead-wires 6 are directed to an outlet, which is provided with a clamp 10 having a projection 101 as shown in FIG. 2, thereby preventing their becoming loose or slipping out at the outlet from the spoke 31.

Figure 3:
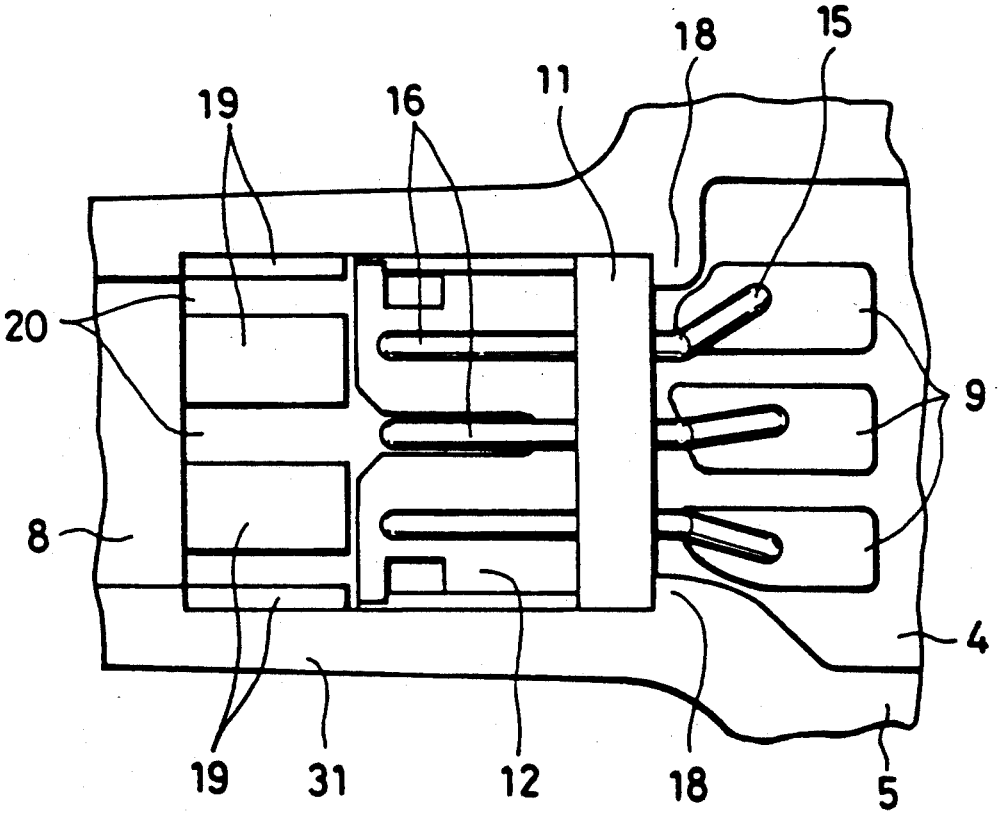
FIG. 3 is an enlarged plan view showing the detail of the assembled in-plug, indicated by a chain line circle in FIG. 2.

FIG. 3 is a detailed view showing the plug 11 accommodated in the cavity 12. As clearly shown by this figure, this structure ensures that the contained components such as the plug 11 and the receptacle 17 do not project from the cavity 12 defined by the outer frame 2, and that there is no obstruction at the time of installing the axial-fan motor to any appliance or apparatus. The plug 11 is vertically put down onto bottom plate 121 of the cavity 12 until the engaging protrusions 13 on both side walls of the cavity are firmly received in the engaging recesses 14 on both side walls of the plug 11. Therefore, the receptacle 17 is slid in the position which is on the guide rails 19 and in the cavity 12 until coupled with the plug 11, namely until the connection pins 16 are inserted in the connection holes in the receptacle 17, thereby making electric connection.

If required, an alternative arrangement of replacing the positions of the plug and the receptacle is also possible.

Although the present invention has been described in its preferred form with a certain degree of particularity, it is understood that the present disclosure of the preferred embodiment may be changed regarding details of construction or the combination and arrangement of parts and components without departing from the spirit and the scope of the invention as hereinafter claimed.

What is claimed is:

1. A brushless dc axial-flow fan motor comprising:

a housing serving as an outer frame, comprising a center hub, a plurality of spokes radially extending from said center hub to a periphery of said housing, and a cavity having two side walls provided in one of said plurality of spokes;

a printed circuit board contained in said center hub and having a plurality of soldering lands facing said cavity;

a plug accommodated in said cavity, having two sides, engaging protrusions, a plurality of connection pins and a plurality of soldering pin ends soldered on said plurality of soldering lands of said printed circuit board; and a detachable receptacle mechanically connected to said plug and having a plurality of lead wires electrically connected to said plurality of connection pins of said plug.

2. A brushless dc axial-flow fan motor as in claim 1, further comprising:

a pair of engaging protrusions provided on said side walls of said cavity; and a pair of engaging recesses engaged with said pair of engaging protrusions formed on said sides of said plug.

3. A brushless dc axial-flow fan motor as in claim 1, further comprising:

a projection having a dovetail-shaped cross-section formed on a bottom of said detachable receptacle; and a guide rail groove for receiving said projection formed on said bottom of said detachable receptacle.

4. A brushless dc axial-flow fan motor as in claim 2, further comprising:

a projection having a dovetail-shaped cross-section formed on a bottom of said detachable receptacle; and a guide rail groove for receiving said projection formed on said bottom of said detachable receptacle.

5. A brushless dc axial-flow fan motor as in claim 1, further comprising:

a pair of stop protrusions for receiving a stress given on said plurality of soldering pin ends and said plurality of soldering lands by pushing said detachable receptacle toward said plug for making mechanical and electrical connections, provided on said side walls of said cavity in a vicinity of said printed circuit board.

6. A brushless dc axial-flow fan motor as in claim 2, further comprising:

a pair of stop protrusions for receiving a stress given on said plurality of soldering pin ends and said plurality of soldering lands by pushing said detachable receptacle toward said plug for making mechanical and electrical connections, provided on said side walls of said cavity in a vicinity of said printed circuit board.

7. A brushless dc axial-flow fan motor as in claim 3, further comprising:

a pair of stop protrusions for receiving a stress given on said plurality of soldering pin ends and said plurality of soldering lands by pushing said detachable receptacle toward said plug for making mechanical and electrical connections, provided on said side walls of said cavity in a vicinity of said printed circuit board.

8. A brushless dc axial-flow fan motor as in claim 4, further comprising:

a pair of stop protrusions for receiving a stress given on said plurality of soldering pin ends and said plurality of soldering lands by pushing said detachable receptacle toward said plug for making mechanical and electrical connections, provided on said side walls of said cavity in a vicinity of said printed circuit board.

9. A brushless dc axial-flow fan motor as in claims 3, 4, 5, 6, 7 or 8, wherein said plug further comprises:

a groove having dovetail-shaped cross-section on a bottom of said plug to be engaged with said projection when said detachable receptacle is slidingly coupled to said plug.

* * * * *